US009474398B1

(12) United States Patent
Farmer

(10) Patent No.: US 9,474,398 B1
(45) Date of Patent: Oct. 25, 2016

(54) FOOD PLATE WITH BEVERAGE SUPPORT

(71) Applicant: Marion Lynn Farmer, Atlanta, GA (US)

(72) Inventor: Marion Lynn Farmer, Atlanta, GA (US)

(73) Assignee: The Go Plate, LLC, Atlanta, GA (US)

( * ) Notice: Subject to any disclaimer, the term of this patent is extended or adjusted under 35 U.S.C. 154(b) by 0 days.

(21) Appl. No.: 14/195,102

(22) Filed: Mar. 3, 2014

Related U.S. Application Data

(63) Continuation of application No. 11/624,996, filed on Jan. 19, 2007, now Pat. No. 8,672,175.

(51) Int. Cl.
*A47G 19/00* (2006.01)
*A47G 19/06* (2006.01)

(52) U.S. Cl.
CPC ..... *A47G 19/06* (2013.01)

(58) Field of Classification Search
CPC ..... A47G 19/02; A47G 19/06; A47G 19/065
See application file for complete search history.

(56) References Cited

U.S. PATENT DOCUMENTS

| | | | |
|---|---|---|---|
| 421,264 | A | 2/1890 | Gibbons |
| 2,042,801 | A | 6/1936 | Pittman |
| 2,117,102 | A | 6/1936 | Pittler |
| 2,352,684 | A | 7/1944 | Braddock |
| 2,916,180 | A | 12/1959 | Alger |
| 3,027,037 | A | 3/1962 | Bronson et al. |
| 3,115,251 | A | 12/1963 | Farrell |
| 3,401,858 | A | 9/1968 | White et al. |
| D214,641 | S | 7/1969 | Malakoff |
| D227,851 | S | 7/1973 | Nowland et al. |
| 3,955,672 | A | 5/1976 | Brundage |
| 4,607,758 | A | 8/1986 | Stevens |
| D286,250 | S | 10/1986 | Prescott |
| 4,732,274 | A | 3/1988 | Bouton |
| D297,799 | S | 9/1988 | Hammer |
| 4,823,958 | A | 4/1989 | Mahmud |
| D308,461 | S | 6/1990 | Hosea |
| 4,938,373 | A | 7/1990 | McKee |
| 4,966,297 | A | 10/1990 | Doty |
| 4,989,742 | A | 2/1991 | Powell |
| 5,058,737 | A | 10/1991 | Patterson et al. |
| 5,060,820 | A | 10/1991 | Boerner |
| 5,085,391 | A | 2/1992 | Berger et al. |
| 5,110,170 | A | 5/1992 | Boatwright |
| 5,111,960 | A | 5/1992 | Zilliox |

(Continued)

OTHER PUBLICATIONS

International Search Report for International Application No. PCT/US08/51122 mailed Jul. 7, 2008, 2 pages.

*Primary Examiner* — Jeffrey Allen
(74) *Attorney, Agent, or Firm* — Thomas | Horstemeyer, LLP

(57) ABSTRACT

A food retaining apparatus and associated methods are described. In one embodiment, the food retaining apparatus includes a food receptacle formed in a first side of a plate. The food retaining apparatus further includes a beverage container receptacle comprising an indented hollow having a receptacle opening, where a beverage container is insertable into the receptacle opening and the opening is located on a second side of the plate, the second side being opposite the first side. Also, in one embodiment, a plurality of ribs extend from an inner wall of the indented hollow, the ribs being positioned to engage a lip on an opening of the beverage container. Alternatively, at least one projection maybe disposed on the inner wall of the indented hollow to grip the beverage container when inserted into the beverage container receptacle.

20 Claims, 14 Drawing Sheets

(56) References Cited

U.S. PATENT DOCUMENTS

| | | | |
|---|---|---|---|
| 5,170,908 | A | 12/1992 | Austin |
| 5,176,283 | A | 1/1993 | Patterson et al. |
| 5,180,079 | A | 1/1993 | Jeng |
| 5,184,750 | A | 2/1993 | Moller |
| 5,207,743 | A | 5/1993 | Costarella et al. |
| 5,234,125 | A | 8/1993 | Roberts |
| 5,240,136 | A | 8/1993 | Patterson et al. |
| 5,249,700 | A | 10/1993 | Dumke |
| 5,292,028 | A | 3/1994 | Patterson et al. |
| 5,294,000 | A | 3/1994 | Yanuzzi |
| 5,310,072 | A | 5/1994 | Matusovsky et al. |
| D351,085 | S | 10/1994 | Schmidt |
| 5,353,952 | A | 10/1994 | Donche |
| 5,419,455 | A | 5/1995 | Russeau |
| 5,542,577 | A | 8/1996 | Friedrich |
| 5,598,944 | A | 2/1997 | Aragona |
| D383,194 | S | 9/1997 | Doughty et al. |
| 5,695,052 | A | 12/1997 | Damato |
| D397,911 | S | 9/1998 | Waldmann |
| 5,803,305 | A | 9/1998 | Perlis et al. |
| 5,853,104 | A | 12/1998 | Rathjen |
| 5,947,011 | A | 9/1999 | Xu |
| 5,954,195 | A | 9/1999 | Krueger et al. |
| 5,971,139 | A | 10/1999 | Bradley |
| 5,984,131 | A | 11/1999 | Krueger et al. |
| 6,021,914 | A | 2/2000 | Schmidt |
| 6,149,027 | A | 11/2000 | Rathjen |
| 6,338,417 | B1 | 1/2002 | Ferraro |
| 6,360,885 | B1 | 3/2002 | Krueger et al. |
| 6,425,480 | B1 | 7/2002 | Krueger et al. |
| 6,439,388 | B1 | 8/2002 | Lerner |
| 6,609,625 | B1 | 8/2003 | Gibbar |
| 6,702,141 | B1 | 3/2004 | Cinque |
| 6,706,297 | B1 | 3/2004 | Toth et al. |
| 6,824,002 | B1 | 11/2004 | Hadland |
| D509,994 | S | 9/2005 | Hadland |
| 2004/0099670 | A1 | 5/2004 | Michaeli |
| 2005/0045629 | A1* | 3/2005 | Conarro et al. ..... 220/23.8 |
| 2005/0184209 | A1 | 8/2005 | Dobos |
| 2006/0261075 | A1 | 11/2006 | MacCarthy |

* cited by examiner

FOOD PLATE WITH BEVERAGE SUPPORT

CROSS REFERENCE TO RELATED APPLICATIONS

This application is a continuation of, and claims priority to, U.S. patent application Ser. No. 11/624,996 filed on Jan. 19, 2007 entitled "FOOD PLATE WITH BEVERAGE SUPPORT," which is incorporated herein by reference in its entirety.

BACKGROUND

It is often the case that individuals attend parties, receptions and the like in which a meal is served from a buffet. Individuals may be faced with somehow of loading a plate full of food and holding a drink at the same time. Unfortunately, this can be somewhat awkward at times and may result in spilled food and drinks.

BRIEF DESCRIPTION OF THE DRAWINGS

Many aspects of the invention can be better understood with reference to the following drawings. The components in the drawings are not necessarily to scale, emphasis instead being placed upon clearly illustrating the principles of the present invention. Moreover, in the drawings, like reference numerals designate corresponding parts throughout the several views.

DETAILED DESCRIPTION

Figure 1:
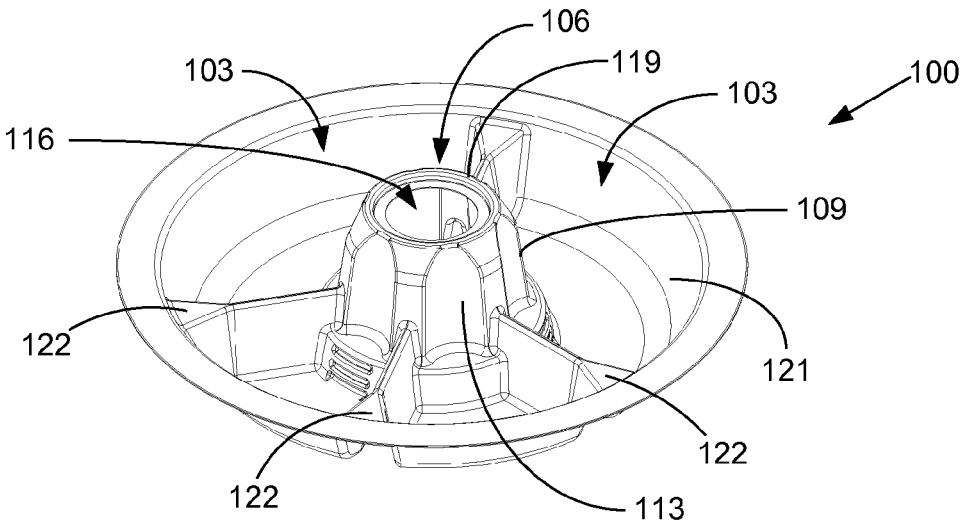
FIG. 1 is a perspective view of a plate according to an embodiment of the present invention.

With reference to FIG. 1, shown is a drawing of a plate 100 according to an embodiment of the present invention. The plate 100 includes several food receptacles 103 on a first side of the plate 100. In one embodiment, the food receptacles 103 are separated by partitions. However, it is understood that in another embodiment, the plate 100 may comprise a single food receptacle with no partitions. The plate 100 also includes a beverage container receptacle 106 that comprises an indented hollow that extends upward from the bottom of the plate 100. The indented hollow includes a receptacle opening on the reverse side of the plate that is opposite the side of the food receptacles 103 as will be described.

The beverage container receptacle includes an inner wall 109 that has several projections 113 that extend inward and are employed to grip a beverage container as will be described. In one embodiment, the projections 113 comprise scallops, although it is possible that other types of projections may be employed. For example, the projections may comprise pointed ridges or other such structures as can be appreciated. The inner wall 109 that includes the projections 113 is tapered to provide for compact stacking of multiple ones of the plates 100 as can be appreciated.

In addition, the beverage container receptacle 106 contains a hole 116 through which the neck of a bottle may be inserted as will be described. In one embodiment, the hole 116 is approximately 1.5 inches in diameter to provide for the greatest compatibility with existing bottles, although it is possible that diameter of the hole 116 may vary significantly. Also, a circular ridge 119 is formed around an upper rim of the beverage container receptacle 106 that is configured to engage a lip of a can as will be described. In addition, the plate 100 includes an outer wall 121 that acts as an outer boundary of the food receptacles 103. The outer wall 121 is tapered to provide for stackability of the plate 100. Also, the food receptacles 103 are relatively deep so as to contain servicing size amounts of liquids such as soup while allowing non liquids such as bread or vegetables, etc. from being mixed with the liquids.

Also, the plate 100 includes thumb rests 122, where each of the thumb rests 122 is triangular in shape and is located at a junction between each of the partitions and the tapered outer wall 121 of the plate 100. The thumb rests 122 advantageously facilitate holding the plate 100 with ones hand at the periphery of the plate 100 without sticking a thumb into the food items placed in the food receptacles 103.

Figure 2:
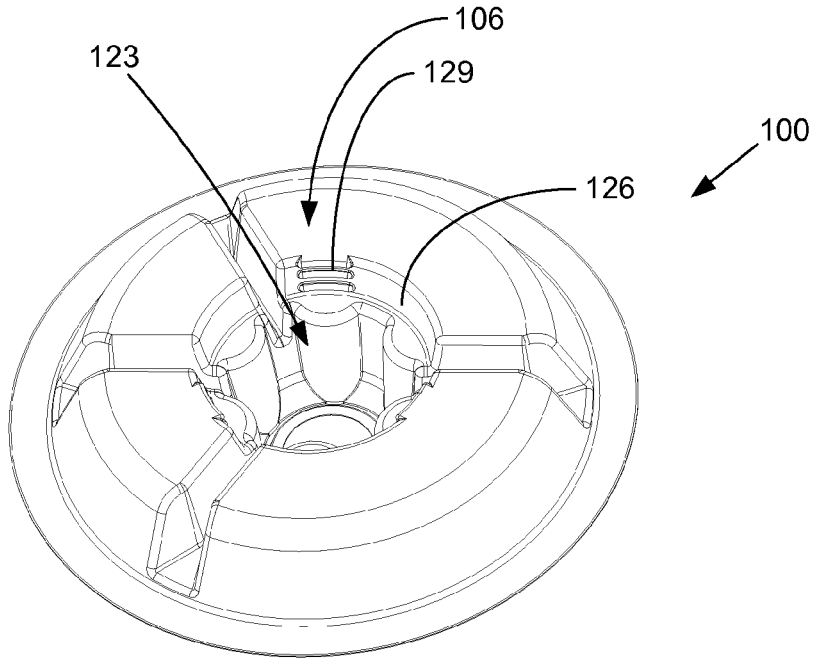
FIG. 2 is a perspective view that shows the underside of the plate of FIG. 1 according to an embodiment of the present invention.

With reference to FIG. 2, shown is a view of the underside of the plate 100 according to an embodiment of the present invention. As shown, the plate 100 includes the receptacle opening 123 through which a beverage container is inserted as will be described. The receptacle opening 123 is thus located on the side of the plate 100 that is opposite the side of the food receptacles 103. This means that a beverage container is inserted into the receptacle opening 123 at the bottom of the plate 100 when food is contained in the food receptacles 103 during use. In addition, the plate 100 also includes a second inner wall 126 with multiple sets of ribs 129. The ribs 129 are employed to engage a lip of a cup as will be described. The inner wall 126 is tapered to provide for stackability of the plate 100 and to accommodate the insertion and retention of cups of different sizes as will be discussed.

According to one embodiment, the plate 100 is formed using a flexible material such as Polyethylene Terephthalate (PET), Crystallized Polyethylene Terephthalate (CPET), Styrene Maleic Anhydride (SMA) such as DYLARK 332 by NOVA Chemicals, High Density Polyethylene (HDPE), Polyvinyl Chloride, Low Density Polyethylene, Polypropylene, Polystyrene, or other materials. As such, the plate 100 may be formed using various processes such as thermoforming including vacuum thermoforming and pressure thermoforming, injection molding, and other processes as can be appreciated. In one embodiment, the plate 100 is not manufactured from a rigid material such as a hard plastic or other rigid material and allows for a degree to compliance. Also, the plate 100 may be manufactured out of paper or other appropriate material. In spite of the degree of compliance or flexibility of the material used to construct the plate 100, the component features of the plate 100 described herein provide for significant rigidity such that the plate may be used for its intended purpose of holding food items during a meal as well as a beverage as will be described. By virtue of the various methods by which the plate 100 may be manufactured with compliant materials, the plate 100 may be made with less expensive manufacturing methods as can be appreciated.

Figure 3:
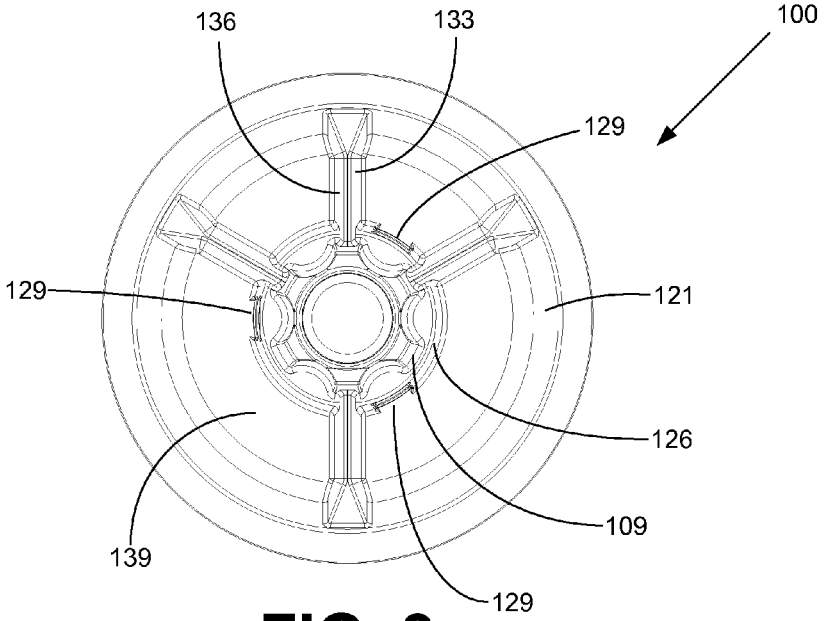
FIG. 3 is a top view of the plate of FIG. 1 according to an embodiment of the present invention.

Referring next to FIG. 3, shown is a top view of the plate 100 according to an embodiment of the present invention. The top view of the plate 100 clearly illustrates the partitions 133 that extend from the outer wall 121 to both the inner walls 109 and 126 of the beverage container receptacle 106. Also illustrated are the sets of ribs 129 that are located at three positions on the inner wall 126 of the beverage container receptacle 106 and are evenly spaced with respect to each other. In addition, it is understood that the ribs 129 may be located at more or less than 3 positions as shown in FIG. 3. In addition, the ribs 129 may be spaced apart at different intervals with respect to each other along with inner wall 126.

Each of the partitions 133 includes side walls 136 that are tapered to facilitate stackability of the plate 100. As referred to herein, the plate 100 is "stackable" in that, when more than one of the plates 100 is arranged in a stack, the bottom of a first one of the plates 100 nests in a top of a second one of the plates 100. Although the side walls 136 of each of the partitions 133 are tapered, they still provide substantially vertical cross support with respect to the bottom surface 139 of the plate 100 to provide for greater rigidity of the entire structure of the plate 100. In particular, the side walls 136 are substantially orthogonal to the plane that runs through the bottom surfaces 139 of the food receptacles 103.

The partitions 133 also serve the purpose of separating the respective food receptacles 103 of the plate 100. Although the plate 100 is shown with the partitions 133, in another embodiment, the plate 100 may be made without the partitions, where a single circular food receptacle 103 is provided. However, such a design might suffer from a degree of instability due to reduced rigidity from the lack of partitions 133.

Figure 4:
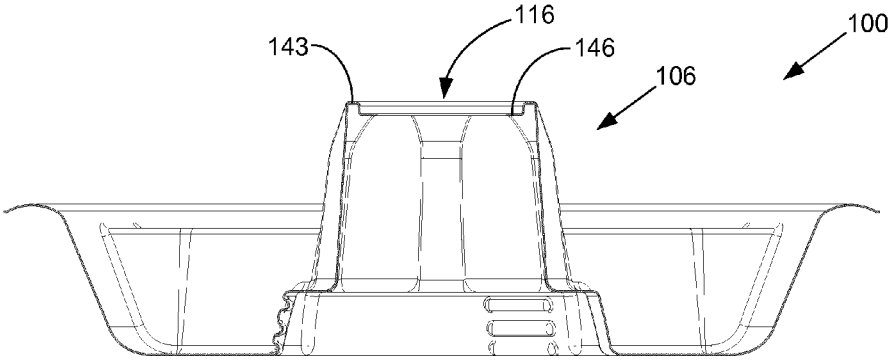
FIGS. 4 and 4A are side views of the plate of FIG. 1 according to embodiments of the present invention.
Figure 4A:
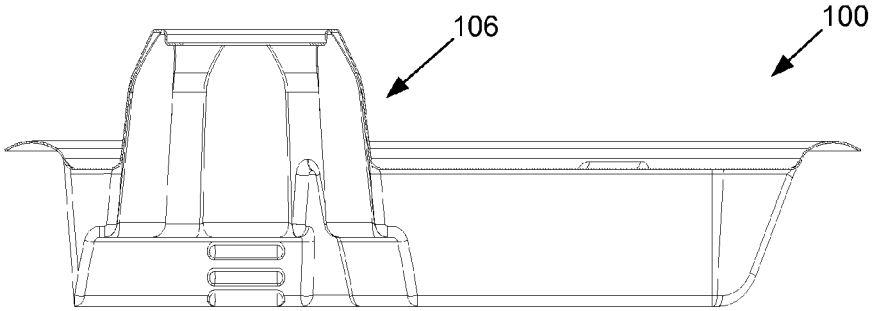

Next, with reference to FIG. 4, shown is a side cutaway view of the plate 100 according to an embodiment of the present invention. As shown, the top of the beverage container receptacle 106 forms a circular ridge that surrounds a depressed flange 146. The hole 116 is situated in the middle of the depressed flange 146. The circular ridge 143 is configured to engage a lip of a typical soda can that would be inserted through the receptacle opening 123 such that the top of the can seats against the depressed flange 146 and the lip of the can is inserted in the circular ridge 143. Referring now to FIG. 4A, shown is a view of the plate 100 according to another embodiment of the present invention. In this embodiment, the beverage container receptacle 106 including an indented hollow is located at the periphery of the plate 100.

Figure 5:
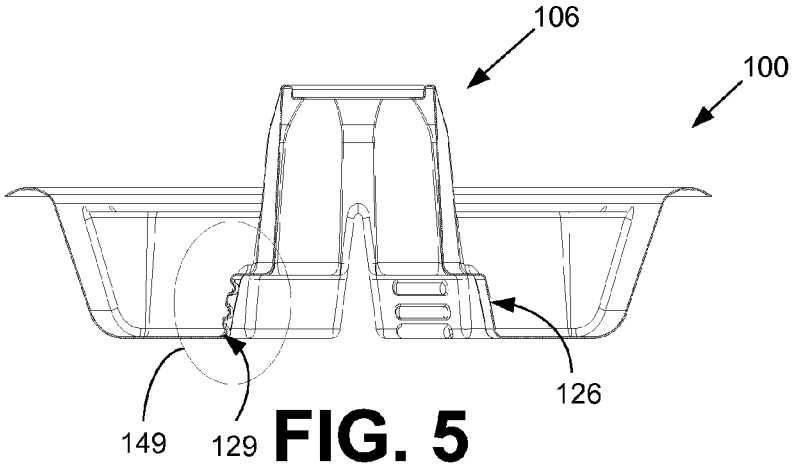
FIG. 5 is a third side view of the plate of FIG. 1 according to an embodiment of the present invention.
Figure 6:
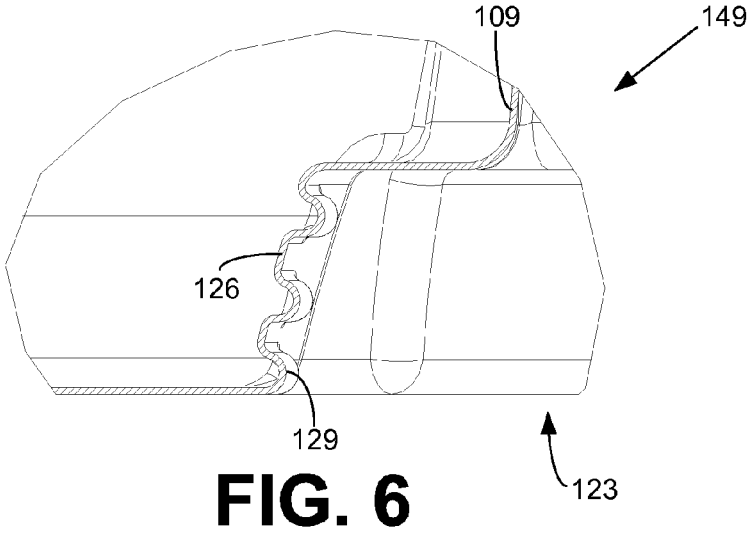
FIG. 6 is a cutaway view of a portion of the plate of FIG. 5 according to an embodiment of the present invention.

Referring next to FIG. 5, shown is a cutaway view of the plate 100 that illustrates a cut out portion 149 drawn around a set of ribs 129 in the inner wall 126 of the beverage container receptacle 106. Referring to FIG. 6, shown is the cutaway portion that particularly illustrates the ribs 129. The ribs 129 include a semi-circular cross section and do not feature a sharp edge, although it is possible that a sharp edge might be used. The semi-circular cross section provides for an easier insertion of a lip of a cup up into the receptacle opening 123.

The inner wall 126 upon which the ribs 129 are located is tapered, thereby allowing the ribs 129 to grip rims of cups of different sizes. That is to say, that a larger cup may only grip the bottom most ribs 129 that are closest to the receptacle opening 123, whereas a smaller sized cup might extend all the way up above the uppermost rib 129 and seat against the transition shelf between the inner wall 109 and the inner wall 126. In one embodiment, the ribs may be specified for a specific type of cup, where the plate 100 is sold together with compatible cups.

As will be described with respect to the following figures, the beverage container receptacle 106 is advantageously compatible with beverage containers that comprise cans, cups, or bottles that typically contain soda, beer, water, or other types of drinks as can be appreciated.

Figure 7:
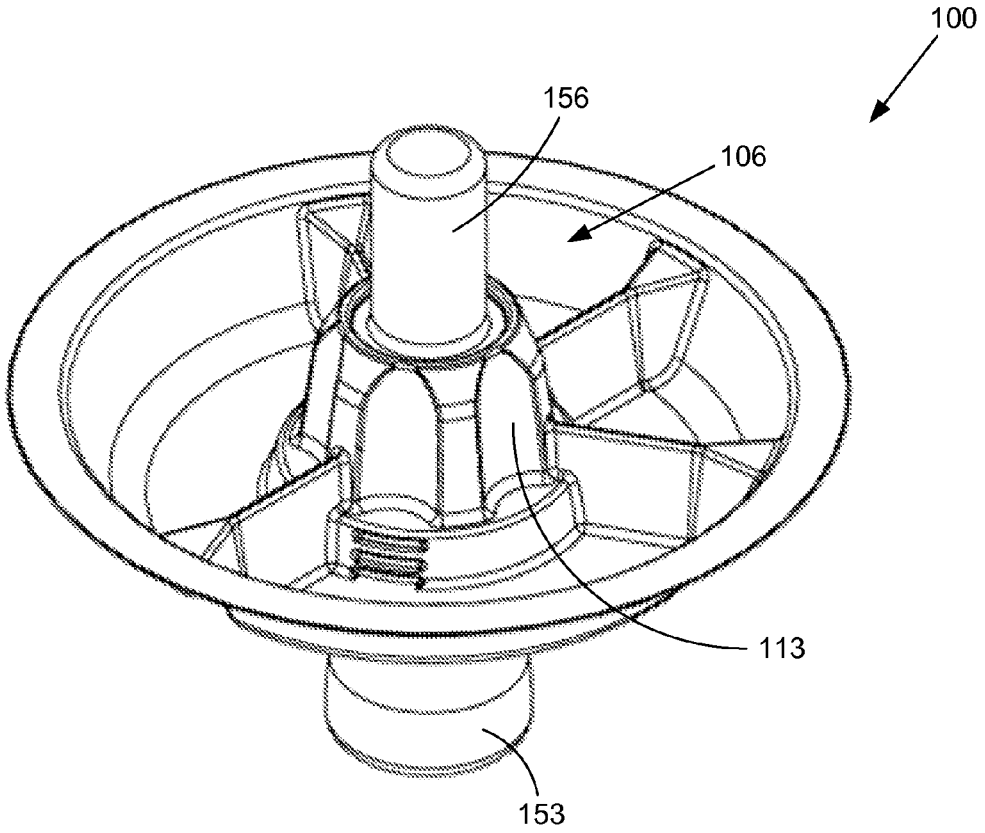
FIG. 7 is a drawing of the plate of FIG. 1 with a bottle inserted in a beverage container receptacle of the plate according to an embodiment of the present invention.

Referring next to FIG. 7, shown is a view of the plate, in which a bottle 153 is inserted into the beverage container receptacle 106. The bottle 153 includes a neck 156 that extends through the opening 116 (FIG. 1) at the top of the beverage container receptacle 106. The projections 113 serve to grip the side of the bottle to hold the plate 100 onto the bottle. In this respect, the user may hold the plate 100 by holding the bottom portion of the bottle 153 once it is secured in the beverage container receptacle 106. The length of the bottom portion of the bottle 153 advantageously sticks out of the bottom of the plate 100 when inserted into the beverage container receptacle 106 so as to be able to accommodate an insulator within which the bottle is placed. Such insulators may comprise, for example, a foam insulated coozie or other such insulator.

Figure 8:
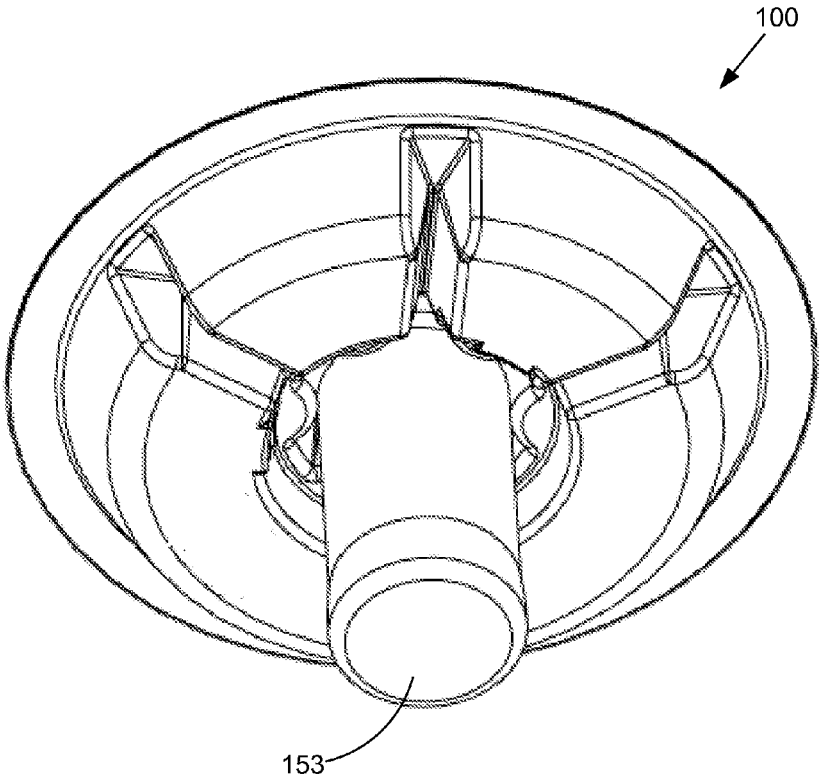
FIG. 8 is a drawing of an underside of the plate and bottle of FIG. 7 according to an embodiment of the present invention.
Figure 9:
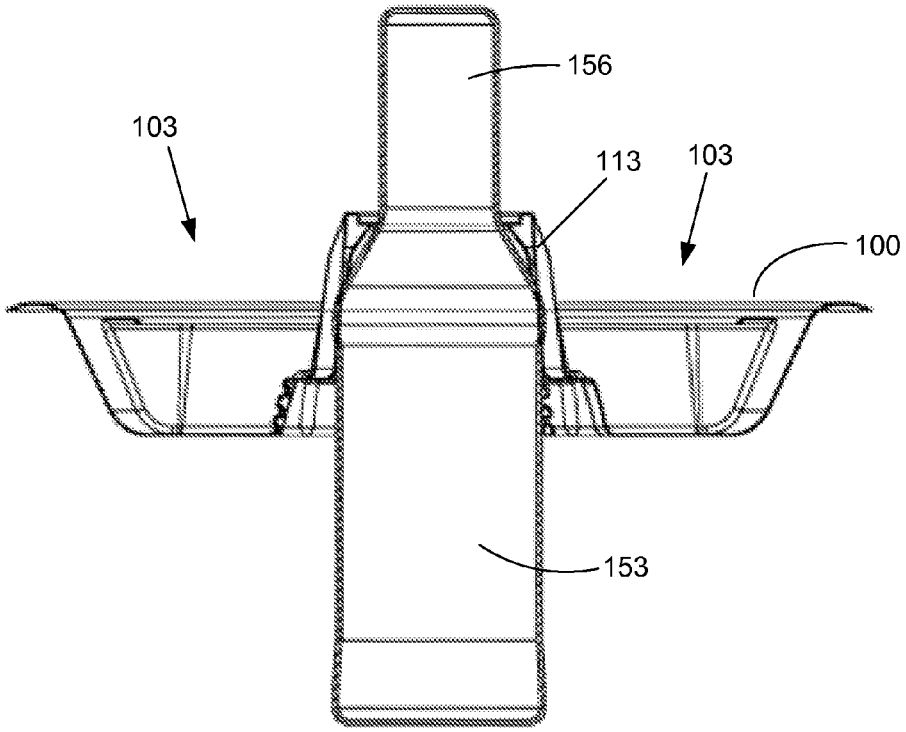
FIG. 9 is a side cutaway view of the plate and bottle of FIG. 7 according to an embodiment of the present invention.

With reference to FIG. 8, shown is the underside of the plate 100 with the bottle 153 inserted therein. In addition, with reference to FIG. 9, shown is a side cutaway view of the plate 100 with the bottle 153 inserted therein, where the projections 113 press against or compress the side of the bottle 153, thereby holding the plate 100 to the bottle 153. The projections 113 generally flex outward when, at the same time, they apply pressure to the side of the bottle 153. The bottom portion of the bottle 153 extends from bottom of the plate 100 and allows a user to hold the plate 100 by grasping the bottle 153. This is advantageous as the user need not use two separate hands to hold both the bottle 153 and the plate 100 while placing food in the food receptacles 103 at a typical buffet, etc., as can be appreciated. In addition, a straw may be placed in the bottle 153 that a user may use to drink the beverage within the bottle 153 without removing the bottle 153 from the beverage container receptacle 106. Note that a straw may also be used where the beverage container is a can or a cup as can be appreciated.

Figure 10:
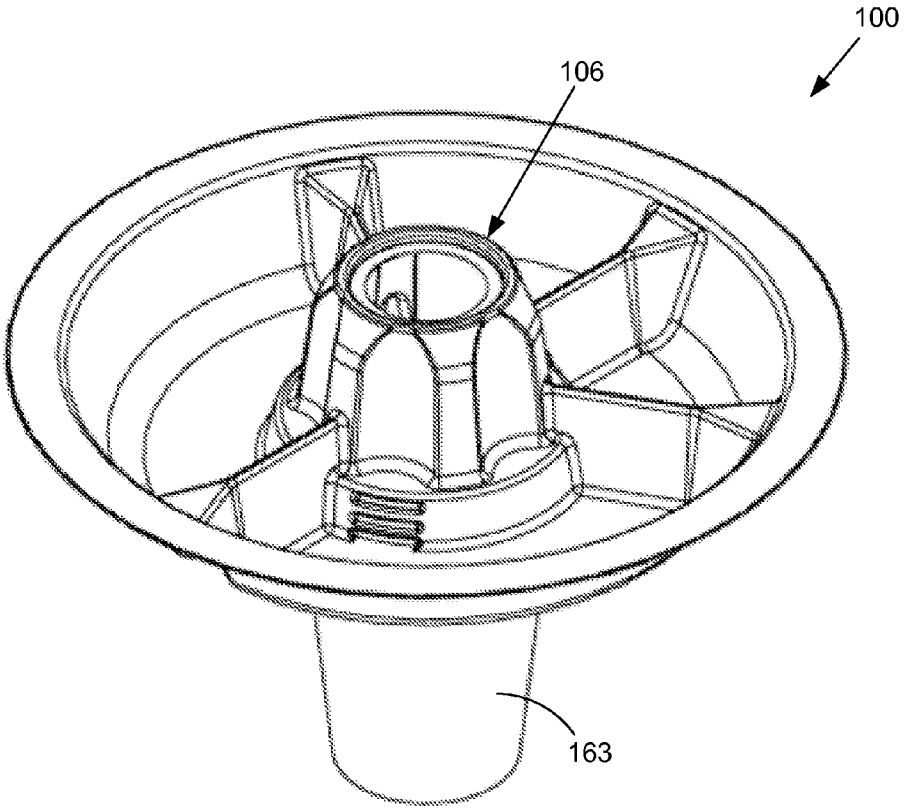
FIG. 10 is a drawing of the plate of FIG. 1 with a cup inserted in a beverage container receptacle of the plate according to an embodiment of the present invention.
Figure 11:
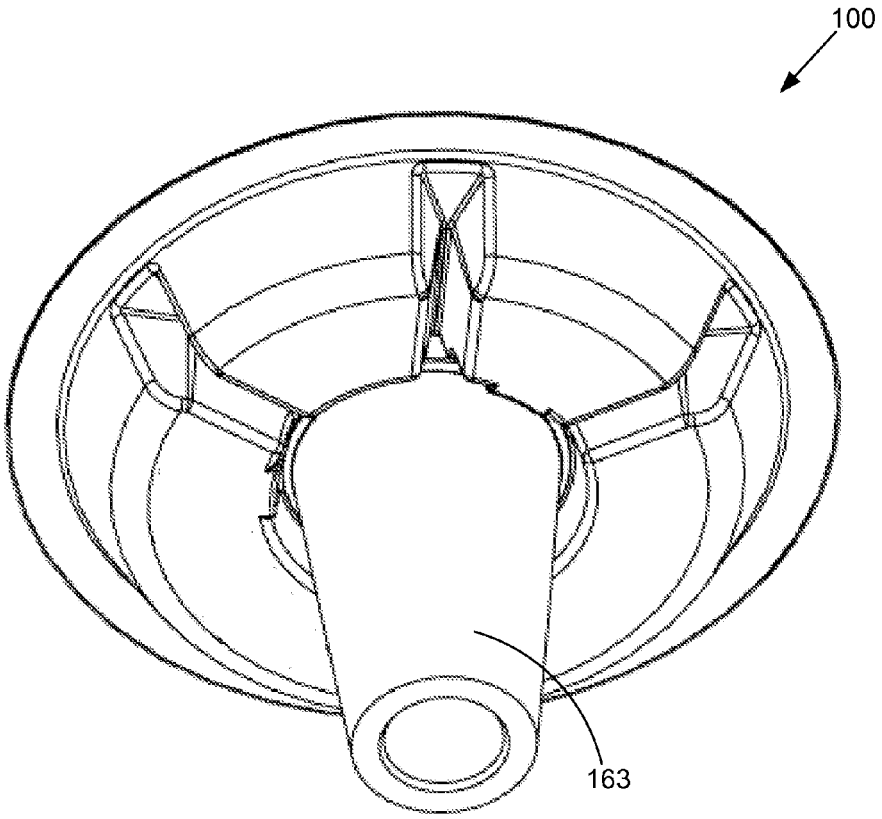
FIG. 11 is a drawing of an underside of the plate and cup of FIG. 10 according to an embodiment of the present invention.
Figure 12:
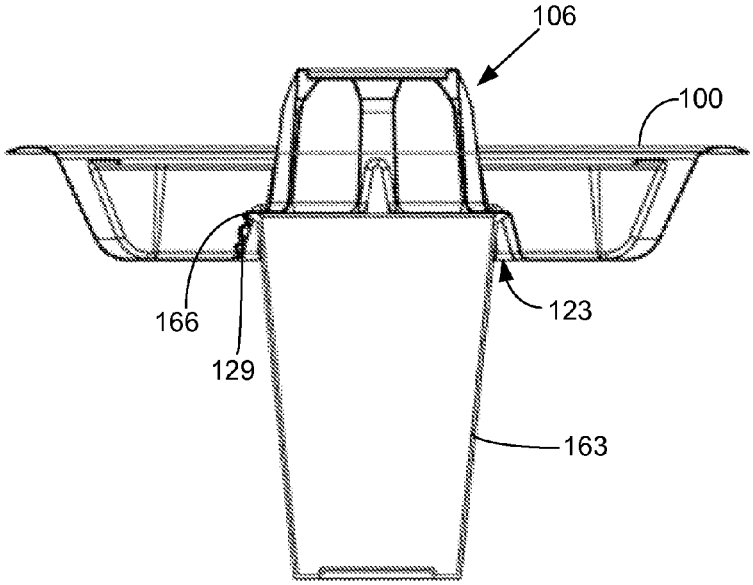
FIG. 12 is a side cutaway view of the plate and cup of FIG. 10 according to an embodiment of the present invention.

With reference to FIGS. 10, 11, and 12, shown is the plate 100 with a cup 163 inserted into the beverage container receptacle 106. As shown, the cup 163 is inserted into the bottom portion of the beverage container receptacle 106, where a top lip 166 of the cup 163 engages the ribs 129, thereby securing the cup 163 to the plate 100 through the receptacle opening 123. As was mentioned above, the cup 163 can be of different sizes with lips 166 with different size peripheries.

Figure 13:
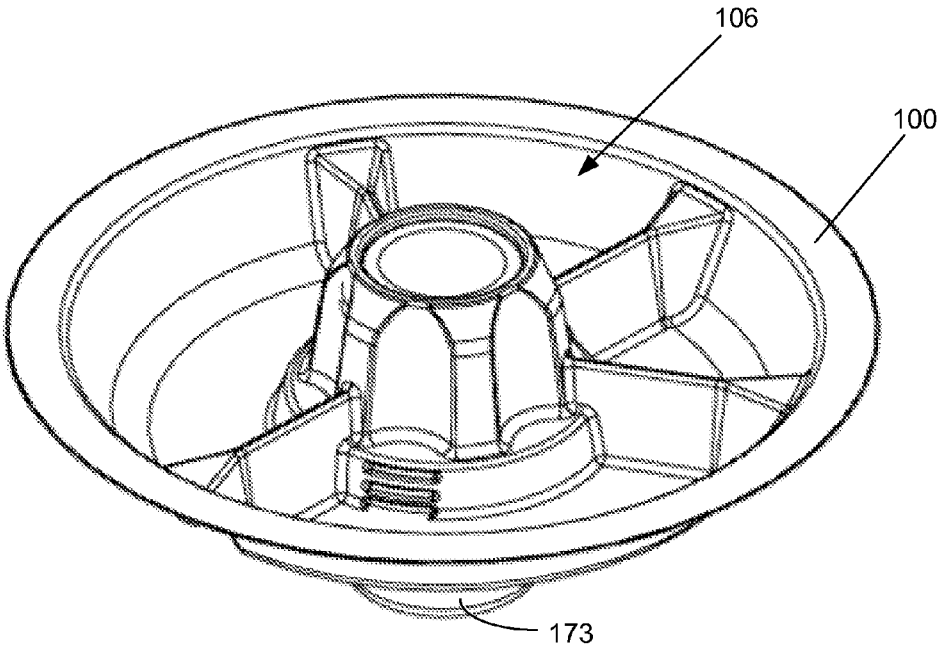
FIG. 13 is drawing of the plate of FIG. 1 with a can inserted in a beverage container receptacle of the plate according to an embodiment of the present invention.
Figure 14:
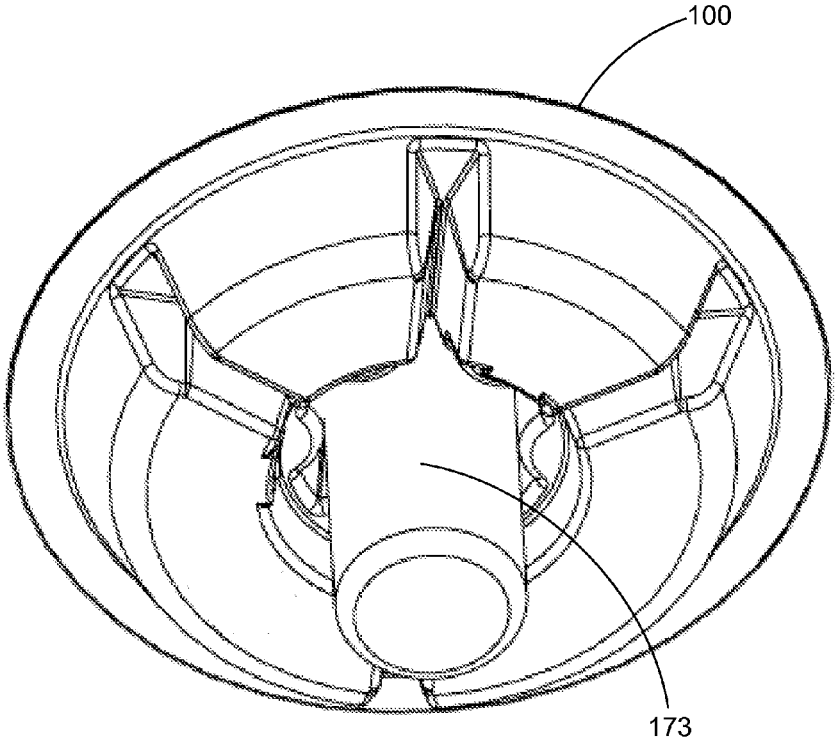
FIG. 14 is a drawing of an underside of the plate and can of FIG. 13 according to an embodiment of the present invention.
Figure 15:
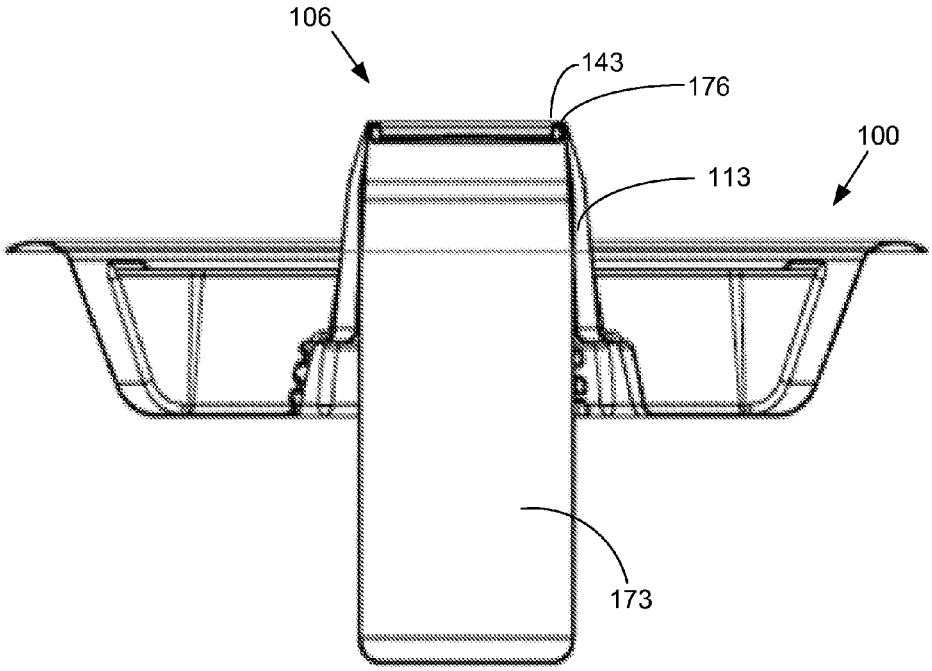
FIG. 15 is a side cutaway view of the plate and can of FIG. 13 according to an embodiment of the present invention.

Referring next to FIGS. 13, 14, and 15, shown is the use of a can inserted into the beverage container receptacle 106 of the plate 100 according to an embodiment of the present invention. The beverage container is a can 173 such as a 12 ounce aluminum can as is typically used to contain soda or beer. It is understood that there may be variation in the sizes of the various types of 12 ounce cans that are used as the beverage container, where one advantage of the beverage container receptacle 106 is that it is universally compatible with all such variations.

In addition, where the cup (FIGS. 10, 11, and 12) and can (FIGS. 13, 14, and 15) extend from the bottom of the plate 100 with sufficient length, an insulator such as a coozie or other insulator may be placed on the cup/can as can be appreciated. Note that the can might be a larger 16 ounce can (i.e. a TALL BOY) that would extend from the bottom of the plate 100 with sufficient length to facilitate a coozie or other insulator.

The various embodiments of the present invention allow a user to insert the respective beverage container, whether it be a bottle, can, cup, or other container into the beverage container receptacle 106 with a bottom portion of the respective beverage container extending from the bottom of the plate 100, thereby allowing a user to hold the plate 100 by grasping the respective beverage container. This is advantageous as the user need not use two separate hands to hold both the beverage container and the plate 100 while placing food in the food receptacles 103 at a typical buffet, etc., as can be appreciated. In addition, while consuming food items placed on the plate 100, according to one embodiment, the plate 100 is constructed with sufficient rigidity to allow a user to hold the plate 100 with one hand, and remove the beverage container with the other hand in order to drink from the beverage container. Once the user is finished drinking from the beverage container, they can insert the beverage container back into the beverage container receptacle 106 and continue to consume the food items on the plate 100. In this manner, messes due to the spilling of drinks out of beverage containers and food off of plates are advantageously avoided.

Shown with reference to FIG. 15, the can 173 includes the rim 176 that seats into the ridge 143 when the can 173 is fully inserted into the beverage receptacle retainer 106. Due to the fact that the rim 176 is seated into the ridge 143, the user may hold the plate by grasping the can 173 at the bottom portion that extends from the bottom of the beverage container receptacle 106 and, when food is placed within the food receptacles 103, any weight that causes the plate to tip in any one direction causes the side of the ridge 143 to engage the side of the rim 176 of the can 173 and provides for greater stability in holding the plate 100 as food is placed therein.

Figure 16:
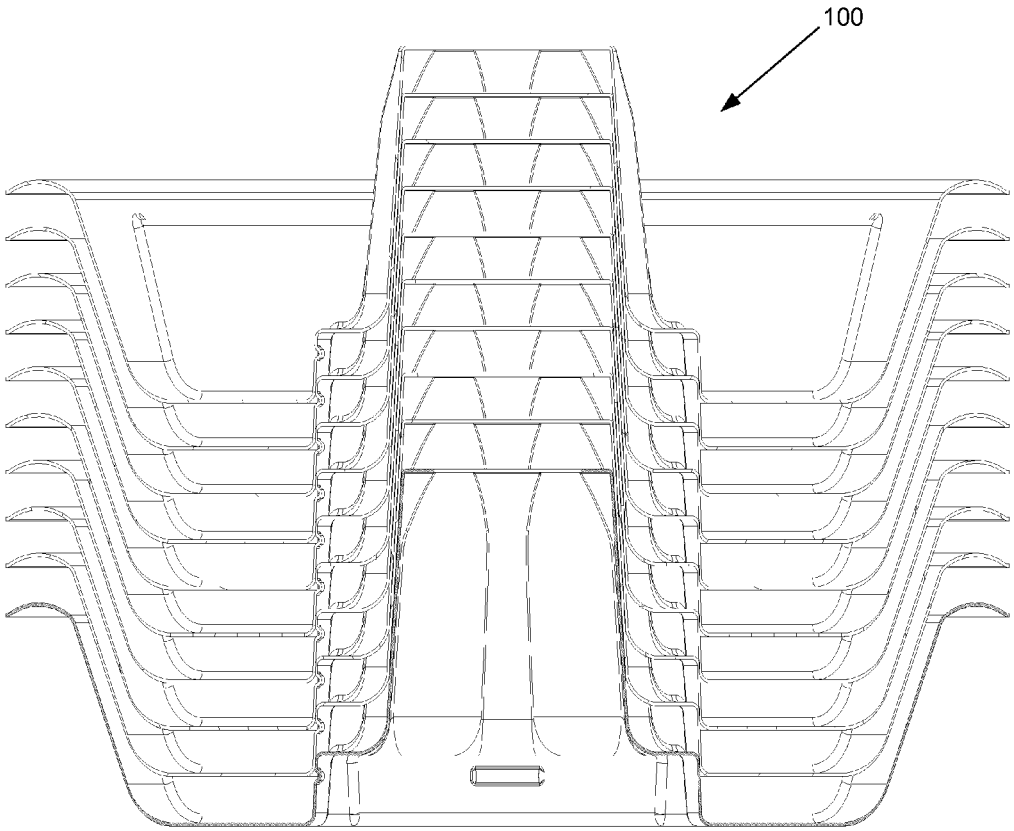
FIG. 16 is a drawing of a plurality of plates as depicted in FIG. 1 arranged in a stack according to an embodiment of the present invention.

With reference to FIG. 16, shown are a plurality of plates 100 stacked in an arrangement in which the bottom of each plate 100 nests into the top of another plate 100. Thus, the specific design of the various components of the plate 100 and in particular, the tapering of each of the various side surfaces allows for the plates 100 to be stacked together as shown for easy shipping and storage on a shelf. In addition, potentially the plates 100 will be packaged and sold in stacks. Thus, the stacks will accommodate packaging in that many more of the plates 100 may be placed within a smaller package given the stackability of the plate 100.

Figure 17:
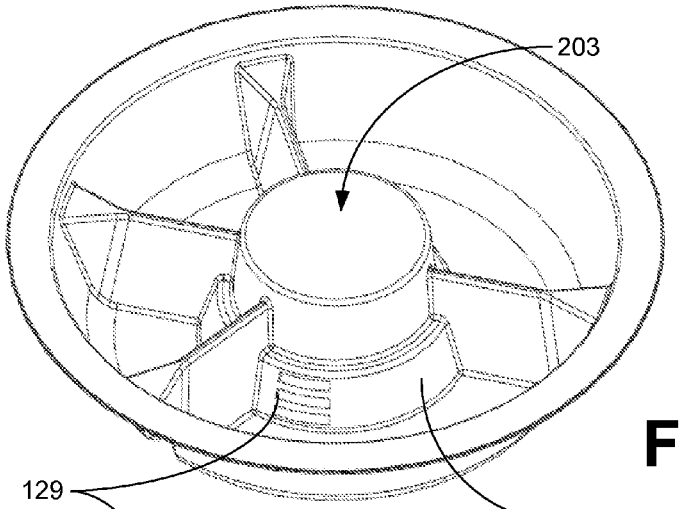
FIGS. 17 and 18 are drawings of a plate according to another embodiment of the present invention.
Figure 18:
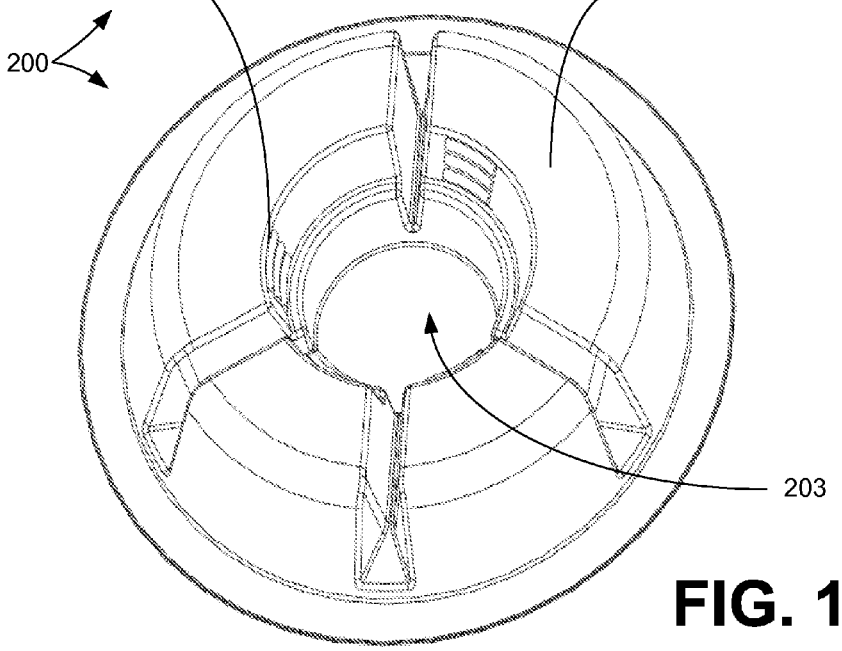

With reference next to FIGS. 17 and 18, shown are respective views of a plate 200 according to another embodiment of the present invention. As shown, the plate 200 includes the bottom portion of the beverage container receptacle 106 denoted herein as beverage container receptacle 203. The beverage container receptacle 203 does not include the upper portion with the projections as described above, where the plate 200 is compatible with the cups as was described with reference to FIGS. 10, 11, and 12. The beverage container receptacle 203 includes ribs 129 as shown. The top of the beverage container receptacle 203 terminates in a flat or concave surface upon which further food items may be placed, alternatively, the flat surface may be recessed to provide for another compartment or food receptacle 103, although the depth of such a recess should not be such that it extends into the beverage container and touches the liquid contained therein. Otherwise, the beverage container receptacle 203 operates in much the similar way as the beverage container receptacle 106 as described with reference to previous figures.

Figure 19:
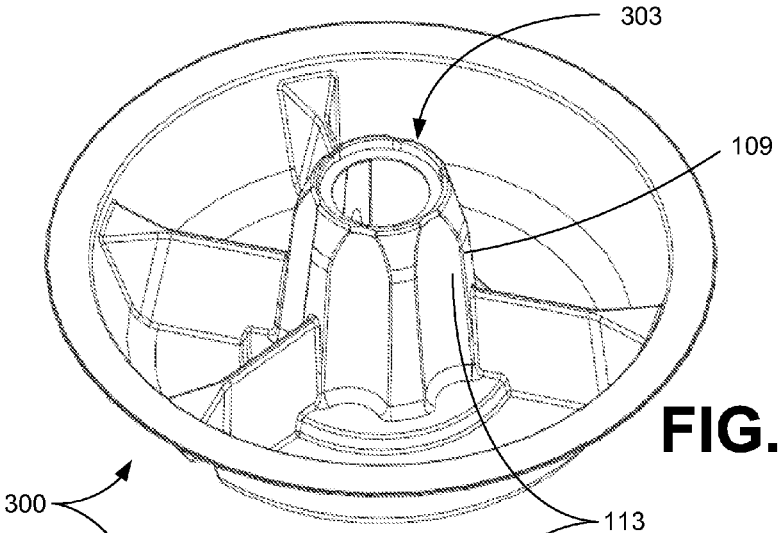
FIGS. 19 and 20 are drawings of a plate according to another embodiment of the present invention.
Figure 20:
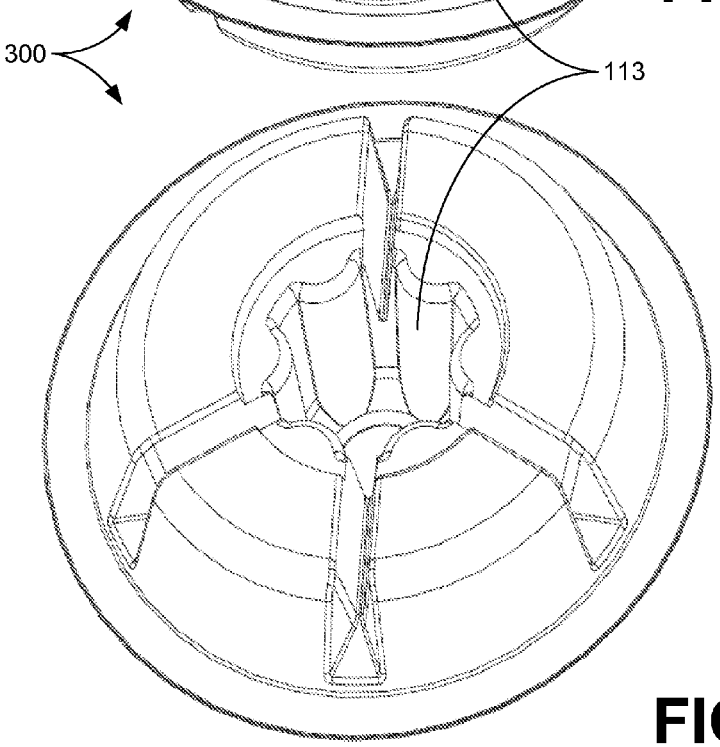

With reference to FIGS. 19 and 20, shown is a plate 300 according to another embodiment of the present invention. The plate 300 does not include the ribs 129 as was described with reference to FIGS. 17 and 18. Accordingly, the plate 300 includes a beverage container receptacle 303 that accommodates both cans and bottles as was described with reference to FIGS. 7-9 and 13-15.

As such, the beverage container receptacle 303 includes the projections 113 and the side wall 109 as described with reference to previous figures, but does not include the inner wall 126 and the ribs 129 to accommodate a cup as described above with respect to FIGS. 17 and 18 above.

Thus, in various embodiments, the plates 100, 200, and 300, may be manufactured to accommodate cups only, cans only (where the opening 116 (FIG. 1) is not included), or bottles with the inclusion of the hole 116.

Also, it should be noted that the design of the plates 100, 200, and 300 are advantageous in that they are universal to the various different sizes of cups, cans, and bottles available on the market. In particular, the flexibility of the materials used to manufacture the plates 100, 200, and 300 along with the specific structural designs described above provide for the near universal compatibility of the plates 100, 200, and 300 with respect to most beverage containers available to consumers.

It should be emphasized that the above-described embodiments of the present invention are merely possible examples of implementations, merely set forth for a clear understanding of the principles of the invention. Many variations and modifications may be made to the above-described embodiment(s) of the invention without departing substantially from the spirit and principles of the invention. All such modifications and variations are intended to be included herein within the scope of this disclosure and the present invention and protected by the following claims.

Therefore, having thus described the invention, at least the following is claimed:

1. A food retaining apparatus, comprising:

a food receptacle formed in a first side of a plate;

a beverage container receptacle comprising an indented hollow having a receptacle opening, wherein a beverage container is insertable into the receptacle opening, the receptacle opening being located on a second side of the plate, the second side being opposite the first side;

wherein at least a portion of the indented hollow further comprises a first inner wall and a second inner wall, the first inner wall having a plurality of curved projections with a convex shape having a curved cross section, the curved projections being configured to grip the beverage container when inserted into the beverage container receptacle, and the curved projections being configured to deform by flexing outwardly relative to a longitudinal axis of the indented hollow to press against a side of the beverage container inserted into the indented hollow;

the second inner wall having a plurality of ribs, the ribs protruding from the second inner wall toward a longitudinal axis of the indented hollow; and wherein an opening is disposed in the indented hollow opposite the receptacle opening.

2. The food retaining apparatus of claim 1, wherein the curved projections comprise a plurality of scallops.

3. The food retaining apparatus of claim 1, wherein the beverage container receptacle is compatible with any one of a can, a cup, or a bottle having a neck.

4. The food retaining apparatus of claim 1, wherein a neck of the beverage container extends through the opening when the beverage container is inserted through the receptacle opening into the beverage container receptacle and the curved projections grip the beverage container.

5. The food retaining apparatus of claim 1, wherein the opening is centered within a recess, wherein a neck of the beverage container extends through the opening when the beverage container is inserted through the receptacle opening into the beverage container receptacle.

6. The food retaining apparatus of claim 1, wherein the plate is stackable.

7. The food retaining apparatus of claim 1, wherein the plate is constructed of a flexible material.

8. The food retaining apparatus of claim 1, further comprising at least one circular ridge extending from the first inner wall at an end of the indented hollow above the plurality of curved projections, the at least one circular ridge configured to engage a top lip on the beverage container.

9. The food retaining apparatus of claim 1, wherein the beverage container receptacle is compatible with a plurality of different beverage container types.

10. The food retaining apparatus of claim 1, wherein the outward flexing of the curved projections accommodates a plurality of different beverage container types having a corresponding plurality of different sizes.

11. A method, comprising:

inserting a beverage container into a receptacle opening of a beverage container receptacle formed in a plate having a first side and a second side, the second side being opposite the first side, wherein:

a food receptacle is formed in the first side of the plate; and the beverage container receptacle comprises an indented hollow and the receptacle opening is located on the second side of the plate, and at least a portion of the indented hollow further comprises a first inner wall and a second inner wall, the first inner wall having a plurality of curved projections with a convex shape having a curved cross section relative to the first inner wall, and the second inner wall having a plurality of ribs, the ribs protruding from the second inner wall toward a longitudinal axis of the indented hollow, wherein an opening is disposed in the indented hollow opposite the receptacle opening; and gripping the beverage container by causing a side of the beverage container to deform the curved projections, the curved projections deforming by flexing outwardly relative to a longitudinal axis of the indented hollow and the curved projections gripping the beverage container by pressing against the side of the beverage container.

12. The method of claim 11, wherein the curved projections comprise a plurality of scallops.

13. The method of claim 11, wherein:

the step of inserting the beverage container further comprises inserting one of a can or a bottle having a neck; and the step of gripping the beverage container further comprises gripping the can or the bottle having the neck.

14. The method of claim 11, further comprising extending a portion of the beverage container through the opening when the beverage container is inserted into the beverage container receptacle and the curved projections grip the beverage container.

15. The method of claim 11, wherein the opening is centered within a recess, and the method further comprises extending a portion of the beverage container through the opening when the beverage container is inserted into the beverage container receptacle and the curved projections grip the beverage container.

16. The method of claim 11, further comprising stacking the plate with at least one other plate.

17. The method of claim 11, further comprising flexing the plate, where the plate is constructed of a flexible material.

18. The method of claim 11, wherein at least one circular ridge extends from the first inner wall at an end of the indented hollow above the plurality of curved projections, and the method further comprises engaging a top lip of the beverage container with the at least one circular ridge.

19. The method of claim 11, wherein the beverage container receptacle is compatible with a plurality of different beverage container types.

20. The method of claim 11, wherein the outward flexing of the curved projections accommodates a plurality of different beverage container types having a corresponding plurality of different sizes.

* * * * *